US006049936A

United States Patent [19]

Holley

[11] Patent Number: 6,049,936

[45] Date of Patent: Apr. 18, 2000

[54] TOOTHBRUSH

[76] Inventor: Richard D. Holley, 19205 N. 52nd La., Glendale, Ariz. 85308

[21] Appl. No.: 09/184,996

[22] Filed: Nov. 3, 1998

[51] Int. Cl.[7] ..... A46B 5/00; B25G 1/00

[52] U.S. Cl. ..... 15/167.1; 15/143.1; 15/145; 15/176.1; 16/422; 16/430

[58] Field of Search ..... 15/143.1, 145, 15/167.1, 176.1; 16/422, 430, 436, DIG. 19

[56] References Cited

U.S. PATENT DOCUMENTS

| | | | |
|---|---|---|---|
| D. 146,271 | 1/1947 | Stavely | D4/104 |
| D. 153,130 | 3/1949 | Fischer | D4/104 |
| 412,479 | 10/1889 | Davis | 264/271 |
| 4,283,808 | 8/1981 | Beebe | 15/145 |
| 4,386,448 | 6/1983 | Kohn | 16/441 |
| 4,429,434 | 2/1984 | Sung-shan | 15/341 |
| 4,523,781 | 6/1985 | Brody | 294/25 |
| 4,592,109 | 6/1986 | Borea et al. | 15/172 |
| 4,719,063 | 1/1988 | White | 264/45.2 |
| 4,875,248 | 10/1989 | Kent | 15/143.1 |
| 5,490,437 | 2/1996 | Hebert et al. | 81/22 |
| 5,781,958 | 7/1998 | Meessmann et al. | 15/167.1 |

FOREIGN PATENT DOCUMENTS

| | | | |
|---|---|---|---|
| 652409 | 3/1929 | France | 15/143.1 |
| 396846 | 8/1933 | United Kingdom | 15/143.1 |

*Primary Examiner*—Mark Spisich
*Attorney, Agent, or Firm*—Frank J. McGue

[57] ABSTRACT

A toothbrush comprises a brush portion and a handle portion. The brush portion has an elongated portion having brush bristles extending laterally from one end thereof. The handle portion has a top cap which is mounted to the other end of the elongated portion opposite the brush bristles and a base cap positioned opposite the top cap. A spine extends between the base cap and the top cap. A sack is mounted on the spine between the base cap and the top cap, the sack being a readily deformable material. The width of the handle portion decreases from the top cap to the base cap.

16 Claims, 1 Drawing Sheet

TOOTHBRUSH

TECHNICAL FIELD

This invention relates in general to toothbrushes, and, more particularly, to toothbrushes suitable for use by those individuals who are manually impaired.

BACKGROUND OF THE INVENTION

A toothbrush generally comprises a brush extending laterally from a handle for cleaning one's teeth. As is well known, proper brushing of one's teeth is a necessary requirement to maintain dental health. However, the handle employed in a toothbrush today is generally a thin, elongated plastic. While most individuals do not have problems using such a handle, those individuals who are manually impaired and do not have full use of the hands due to infirmities such as rheumatoid arthritis may experience a great deal of difficulty. Thus, there is a need for a toothbrush which can be used by manually impaired persons.

U.S. Pat. No. 4,719,063 entitled "Method of Making Implement Handle for Crippled Persons" which issued on Jan. 12, 1988 to White discloses a method of making an implement handle for crippled persons involving an initially flexible bag which is filled with material in the plastic state. The crippled person grips the bag and holds the grip until the plastic sets to a rigid state.

U.S. Pat. No. 5,490,437 entitled "Hammer" which issued on Feb. 13, 1996 to Hebert et al. shows a hammer having a handle which has a bore hole which is filled with a gelatinous material to assist in absorbing shocks from the hammer.

U.S. Pat. No. 4,523,781 entitled "Gripping Aid for the Manually Disabled" which issued on Jun. 18, 1985 to Brody discloses a semi-flexible gripping aid for manually disabled people. One use is to hold a toothbrush.

U.S. Pat. No. 4,283,808 entitled "Gripping Device for Tooth Brushes" which issued on Aug. 18, 1981 to Beebe provides a gripping device to make a toothbrush easier to grasp.

U.S. Pat. No. 4,592,109 entitled "Toothbrush with a Device for the Perfect Orientation of the Bristles with respect to the Surface of the Teeth" which issued on Jun. 3, 1986 to Borea et al. discloses a toothbrush having an anatomical grip which has fixing means on one end for a short rod having a head of bristles on the end.

None of the references disclose the present invention. Thus, there is a need to provide a toothbrush for use by the manually impaired.

Further objects and advantages of the invention will become apparent as the following description proceeds and the features of novelty which characterize this invention will be pointed out with particularity in the claims annexed to and forming a part of this specification.

DESCRIPTION OF THE PREFERRED EMBODIMENT

Figure 1:
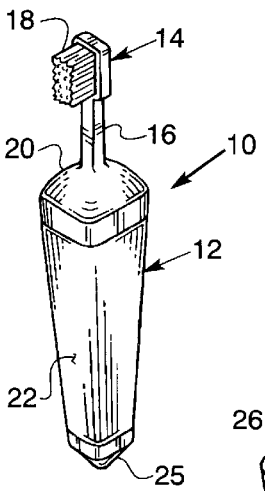
FIG. 1 is a perspective view of one embodiment of the present invention.
Figure 2:
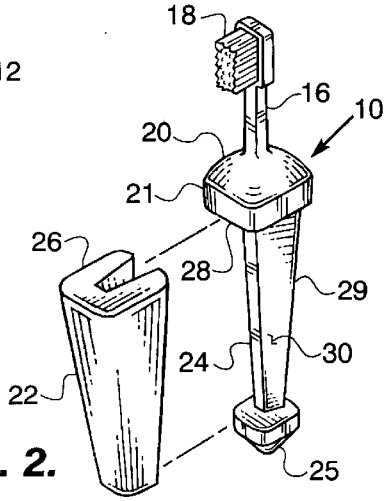
FIG. 2 is a perspective exploded view of the embodiment of FIG. 1 showing the spine separated from the bag.
Figure 3:
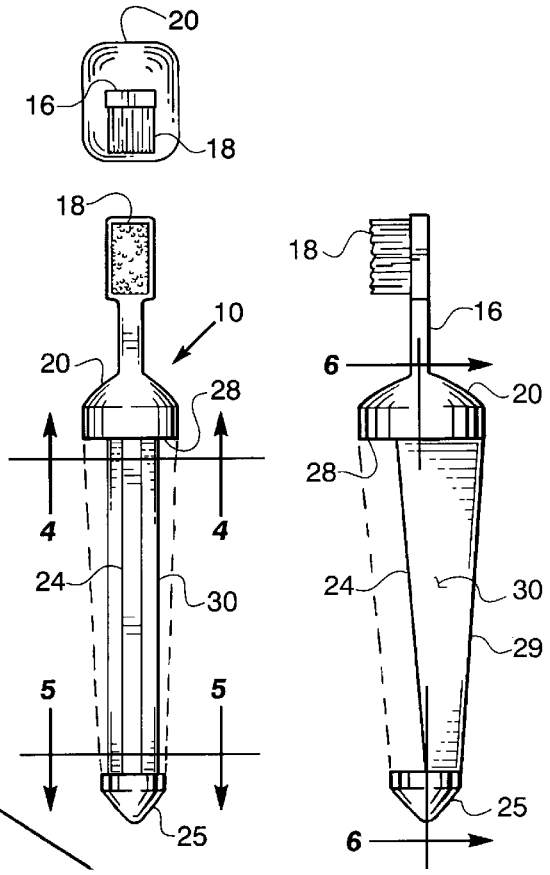
FIG. 3 are front, side, top, and bottom views of the spine component of FIG. 2.

The present invention is best shown in FIGS. 1 and 2. A toothbrush 10 comprises a handle portion 12 and a brush portion 14. Brush portion 14 includes an elongated portion 16 having brush bristles 18 extending laterally from one end thereof.

Handle portion 12 extends downwardly from a top cap 20. Top cap 20 has an upwardly extending flattened conical shape with a rounded square base 21 which is mounted at the opposing end of elongated portion 16. In the preferred embodiment, handle portion 12 also includes a sack 22, a base cap 25 and a spine 24 extending between base cap 25 and top cap 20. In the presently preferred embodiment spine 24, base cap 25, top cap 20 and elongated portion 16 are integrally formed from an appropriate plastic material such as polystyrene. Those skilled in the art will recognize that other materials are suitable for use. Base cap 25, in the illustrated embodiment, is a downwardly extending flattened conical shape with a smaller rounded square base 27 centered on and mounted in opposition to base 21 of top cap 20.

It will be understood that the actual shapes of caps 20 and 25 can vary and are not meant to be limited to those illustrated herein. For example, both caps 20 and 25 can be circular in profile if desired. Other shapes will be apparent to those skilled in the art.

Figure 4:
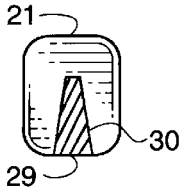
FIG. 4 is a cross sectional view of the spine of FIG. 3 taken along line 4—4.
Figure 5:
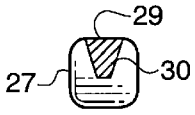
FIG. 5 is a cross sectional view of the spine of FIG. 3 taken along line 5—5.
Figure 6:
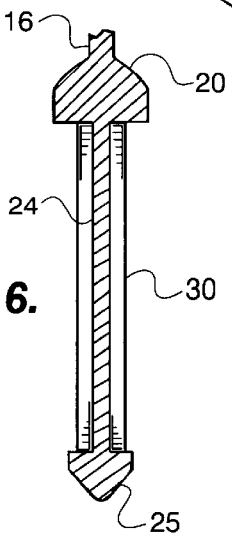
FIG. 6 is a cross sectional view of the spine of FIG. 3 takien along line 6—6.

Spine 24 connects base cap 25 and top cap 20. A rear edge 29 of spine 24 mates with the side of base cap 25 and top cap 20 opposite the laterally extending brush bristles 18. A body 30 of spine 24 extends inwardly about two thirds (⅔) of the width of handle 12 from the rear edge 29. In the illustrated embodiment best seen in FIGS. 4 and 5, body 30 presents an trapezoidal cross section.

Sack 22 is a resilient, deformable construction. While those skilled in the art will recognize that other materials are suitable for use, in one embodiment, sack 22 is made from a urethane film. In the preferred embodiment, sack 22 includes interior spaces which are filled with a gel material such as a room temperature elastically deformable polyurethane gel. Sack 22, as best seen in FIG. 2, presents a thick walled U-shape in a horizontal cross section. A cavity formed by the walls of the U-shape mates with inwardly extending portion of spine 24. An upper periphery 26 of sack 22 mates with an underside periphery 28 of top cap 20 while a lower periphery of sack 22 mates with topside periphery of base cap 25. In the presently preferred embodiment, sack 22 is permanently attached to caps 20, 25 and spine 14 with an appropriate glue.

The sloping of sack 22 from top cap 20, preferably about to smaller base cap 25 is purposefully designed to allow users with varying hand sizes as well as the common hand deformations of arthritis to use the device. In one preferred embodiment, top cap 20 is about 3.2 centimeters across while base cap 25 is about 1 centimeter across resulting in an inverted slope of about 4 degrees for a 30 centimeter long device. In addition, sack 22 is formed of a plastic, rubber or fabric outer surface which provides a no-slip surface for the user to grasp.

Figure 7:
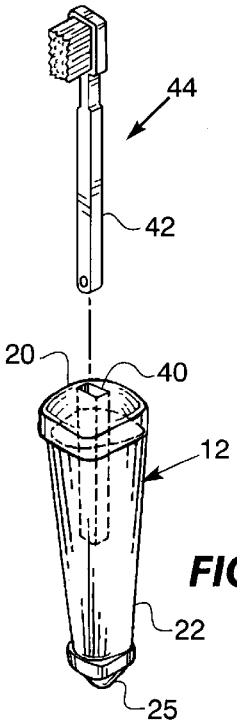
FIG. 7 is a perspective view of an alternate embodiment of the present invention.

In the embodiment of FIG. 7, brush portion 14 is detachable from handle portion 12. In this embodiment, body 30 is provided with a channel 40 which receives a standard handle 42 of a toothbrush 44 which corresponds to handle portion 12. This embodiment is useful for allowing users to purchase one handle 12 for multiple users, or for those users who have a strong preference for a particular toothbrush 44. Insertion of handle portion 12 into rigid body 30 provides stability.

Although only certain embodiments have been illustrated and described, it will be apparent to those skilled in the art that various changes and modifications may be made therein without departing from the spirit of the invention or from the scope of the appended claims.

That which is claimed is:

1. A toothbrush comprising:

a brush portion, the brush portion having an elongated portion having brush bristles extending laterally from one end thereof;

a handle portion having a top cap which is mounted to the other end of the elongated portion opposite the brush bristles, a base cap positioned opposite the top cap, a spine extending between the base cap and the top cap, a sack being mounted on the spine between the base cap and the top cap, the sack being a readily deformable material, the width of the handle portion decreasing from the top cap to the base cap.

2. The device of claim 1 wherein the spine, the base cap, the top cap and the elongated portion are integrally formed.

3. The device of claim 1 wherein the top cap is a upwardly extending flattened conical shape and the base cap is a smaller downwardly extending flattened conical shape centered on the top cap.

4. The device of claim 1 wherein the spine includes a rear edge opposite the laterally extending brush bristles and a body extending inwardly from the rear edge towards the center of the handle portion.

5. The device of claim 4 wherein the body extends inwardly about two thirds of the width of the handle portion.

6. The device of claim 5 wherein the body presents an trapezoidal cross section.

7. The device of claim 6 wherein the sack presents a thick walled U-shape in a horizontal cross section, the sack further having a cavity formed by the walls of the U-shape, the cavity mating with the body.

8. The device of claim 1 wherein the sack is permanently attached to the caps and the spine with glue.

9. The device of claim 1 wherein the sack includes interior spaces which are filled with a gel material.

10. The device of claim 1 wherein the sack has a non-slip outer surface.

11. The device of claim 1 wherein the brush portion is detachable from the handle portion.

12. The device of claim 11 wherein the handle portion is provided with a channel and the elongated portion is a standard toothbrush handle, the channel receiving the handle.

13. A toothbrush comprising:

a brush portion, the brush portion having an elongated portion having brush bristles extending laterally from one end thereof;

a handle portion having a top cap which is mounted to the other end of the elongated portion opposite the brush bristles, a base cap positioned opposite the top cap, a spine extending between the base cap and the top cap, the spine including a rear edge opposite the laterally extending brush bristles and a body extending inwardly from the rear edge about two thirds of the width of the handle portion, a sack having a cavity, the cavity mating with the body, the sack extending between the base cap and the top cap, the sack being a readily deformable material, the width of the handle portion decreasing from the top cap to the base cap, the top cap being a upwardly extending flattened conical shape and the base cap being a smaller downwardly extending flattened conical shape centered on the top cap.

14. The device of claim 13 wherein the brush portion is detachable from the handle portion.

15. The device of claim 14 wherein the body is provided with a channel and the elongated portion is a standard toothbrush handle, the channel receiving the handle.

16. The device of claim 13 wherein the spine, the base cap, the top cap and the elongated portion are integrally formed.

* * * * *